US005252042A

United States Patent [19]

Yonezawa

[11] Patent Number: 5,252,042

[45] Date of Patent: Oct. 12, 1993

[54] GAS BOOSTER ASSEMBLY FOR FLUID PRESSURE PISTON DRIVING APPARATUS

[75] Inventor: Keitaro Yonezawa, Kobe, Japan

[73] Assignee: Kabushiki Kaisha KOSMEK, Hyogo, Japan

[21] Appl. No.: 925,919

[22] Filed: Aug. 7, 1992

[30] Foreign Application Priority Data

Aug. 9, 1991 [JP] Japan ..... 3-224857
Aug. 9, 1991 [JP] Japan ..... 3-224858
Aug. 23, 1991 [JP] Japan ..... 3-074611[U]

[51] Int. Cl.[5] ..... F04B 35/00

[52] U.S. Cl. ..... 417/401; 417/488; 92/85 B

[58] Field of Search ..... 92/85 B; 417/488, 401

[56] References Cited

U.S. PATENT DOCUMENTS 2,711,697 6/1955 Gibbs ..... 417/274
3,158,048 11/1964 Bollar ..... 92/85 B
3,431,725 3/1969 Chen ..... 92/85 B
3,805,672 4/1974 Pekrul ..... 92/85 B
3,835,753 9/1974 Bunyard ..... 92/85
3,938,425 2/1976 Kroffke ..... 92/60.5
4,042,311 8/1977 Yonezawa ..... 417/401
4,700,611 10/1987 Kaneko ..... 92/85 B
4,812,109 3/1989 Yonezawa ..... 417/401
5,050,482 9/1991 Yonezawa ..... 91/304

*Primary Examiner*—Richard A. Bertsch
*Assistant Examiner*—Peter Korytnyk
*Attorney, Agent, or Firm*—Bacon & Thomas

[57] ABSTRACT

A first cylinder bore (7) for accommodating a first piston (8), a plunger bore (20) for accommodating a plunger (21), and a second cylinder bore (57) for accommodating a second piston (58) are provided in this order from above. The plunger (21) is fixed to the first piston (8). A cushion chamber (61), provided below the second piston (58), and an outlet (25*b*) of a second check valve (25) for gas discharge are connected to each other via a communicating passage (62). The second piston (58) is prevented from moving upward in excess of a set extent by a stopper (64) provided in the peripheral wall of the second cylinder bore (57).

7 Claims, 6 Drawing Sheets

GAS BOOSTER ASSEMBLY FOR FLUID PRESSURE PISTON DRIVING APPARATUS

BACKGROUND OF THE INVENTION

1. Field of the Invention

The present invention relates to a gas booster which is connected in series with a large-in-diameter piston to be reciprocatingly driven by pressurized fluid such as compressed air and a small-in-diameter plunger inserted into a plunger chamber, a low-pressure gas introduced into the plunger chamber being boosted according to the sectional area ratio of the piston to the plunger.

2. Description of the Prior Arts

A hydraulic clamp is commonly adopted as the fluid-pressure clamp for fixing a die to a fixed base such as an injection molding machine. The hydraulic clamp is indeed superior in capability of yielding a strong clamping force with a high-pressure oil of approx. 250 $kgf/cm^2$, which allows the clamping device to be compacted. However, it also allows the oil to leak, although very small in amount, from the high-pressure oil sealing packing, causing the atmosphere to be contaminated therewith. For this reason, the hydraulic clamp has a limit in accomplishing the demand of ultra-cleaning, which is growing pronouncedly in recent years.

The present inventor has previously devised a clamping system as described below with a view to satisfying both the demand of cleaning mentioned above and the compacting of the fluid-pressure clamp. The clamping system is a technique that a compressed air of approx. 5 $kgf/cm^2$ supplied from an air compressor is boosted to approx. 40 $kgf/cm^2$ by a gas booster and the resulting high-pressure air is used as a working fluid for the fluid-pressure clamp.

The above-mentioned gas booster is so arranged that a gas pump is driven by a pneumatic piston engine, which is disclosed in U.S. Pat. Nos. 4,042,311 or 4,812,109 previously proposed by the present inventor.

More specifically, in this gas booster, an engine chamber is provided above the pneumatic piston, to or from which engine chamber compressed air is supplied and discharged by a supply/discharge switching means, while a plunger smaller in diameter than the pneumatic piston is provided so as to downwardly protrude from the pneumatic piston, and a plunger chamber is provided below the plunger, with a first check valve for gas intake and a second check valve for gas discharge both connected to a lower portion of the plunger chamber.

The gas booster operates in such a manner that the downward fluid pressure acting on the pneumatic piston from the engine chamber surpasses the upward discharge reaction force acting on the plunger from the plunger chamber to thereby downwardly drive the pneumatic piston; therefore, at the time of high load, when a specified time period has elapsed since the startup of the gas pump so that the discharge pressure has increased to a sufficient extent, the piston and the plunger are driven to descend at low speed. The resulting descending inertia force of the piston at the time of high load is so small that when compressed air is discharged from the engine chamber by the supply/discharge switching means at a time point when the piston has descended almost to the bottom dead point, the piston will be immediately turned over to an ascending return stroke.

In contrast to this, at the time of low load when the discharge pressure is low, the piston and the plunger are driven to descend at high speed; therefore, the descending inertia force of the piston is so great that even though the piston is turned over to the ascending return stroke almost at the bottom dead point, the piston will downwardly overrun the bottom dead point for high load, making the descending stroke of the plunger excessively extend.

In connection with the technical background as described above, a prior art known by the present inventor is such that the depth dimension of the plunger chamber is set so as to be slightly deeper than the descending stroke of the plunger at the time of low load to thereby prevent the plunger from colliding against the bottom wall of the plunger chamber at a final period of the descending stroke of the first piston.

The prior art mentioned above has the following problem.

That is, when the gas pump is at high load, the bottom dead point of the piston is elevated higher than it is at the time of low load, causing the clearance between the bottom wall of the plunger chamber and the bottom end of the plunger to be increased. This in turn causes the compressibility of the plunger chamber to be reduced, with the result that the amount of discharged gas is reduced to an extent of the decrement in the compressibility. The gas booster, as a consequence, is long in the pressure boosting time.

SUMMARY OF THE INVENTION

An object of the present invention is therefore to reduce the boosting time.

To accomplish the foregoing object, the present invention provides a gas booster constructed as follows. A first cylinder bore, a plunger bore smaller in diameter than the first cylinder bore, and a second cylinder bore are formed in this descending order. A first piston inserted into the first cylinder bore and a plunger inserted into the plunger bore are connected so as to extend vertically while a second piston is inserted into the second cylinder bore. To or from an engine chamber formed between the top wall of the first cylinder bore and the first piston, a pressure fluid is supplied or discharged by a supply/discharge switching means. A plunger chamber is formed between the plunger and the second piston while a cushion chamber is formed between bottom wall of the second cylinder bore and the second piston. A first check valve for gas intake and a second check valve for gas discharge are connected to an internal lower portion of the plunger chamber. The cushion chamber and the outlet of the second check valve are connected to each other with a communicating passage. The second piston is prevented from moving upward in excess of a set extent by means of a stopper.

The gas booster according to the present invention operates as follows.

With the load at low level, the pressure of the outlet of the second check valve and that of the plunger chamber are so low that the first piston and the plunger are driven to rapidly descend, causing a great descending inertia force of the first piston. On this account, at a final period of the descending stroke, the bottom end of the plunger comes into contact with the second piston, and subsequently the plunger pushes the second piston down against the gas pressure of the cushion chamber. On the other hand, when the plunger is turned over to ascend, the second piston returns to the ascending position from the descending position with the pressure of the cushion chamber.

As the plunger repeats the above-described up-down strokes, the pressure of the outlet of the check valve gradually increases. The descending speed of the first piston decreases accordingly, so that the inertia force of each of the first piston and the plunger becomes smaller when they descend, causing the overrun of the bottom end of the plunger to gradually decrease. With the decreasing overrun, the height level of the second piston is elevated by the pressure acting from the cushion chamber to the second piston to thereby eliminate or reduce the clearance between the bottom end of the plunger and the second piston. This contributes to maintaining the compressibility of the plunger chamber at a great value.

Since the gas booster of the present invention is constructed and operates as described above, the amount of gas discharge can be increased over the whole range from low load to high load by increasing the compressibility of the plunger chamber at the time of high load, thus allowing the pressure boosting time to be reduced.

Moreover, since the descending travel of the plunger can be cushioned by compressing operation of the cushion chamber, the descending travel is gradually decelerated such as to result in small colliding force due to collision between the plunger and the second piston. In consequence, the gas booster produces only low level vibrations and noise.

BRIEF DESCRIPTION OF THE DRAWINGS

FIG. 1 is a longitudinal sectional view of a gas booster;

FIG. 2 is an operation explanatory view of a piston engine of the booster;

FIGS. 3 are operation explanatory views of a gas pump of the booster;

FIG. 5 is a view equivalent to FIG. 4;

FIG. 6 is a view equivalent to FIG. 2; and

DESCRIPTION OF THE PREFERRED EMBODIMENTS

First Embodiment

Figure 1:
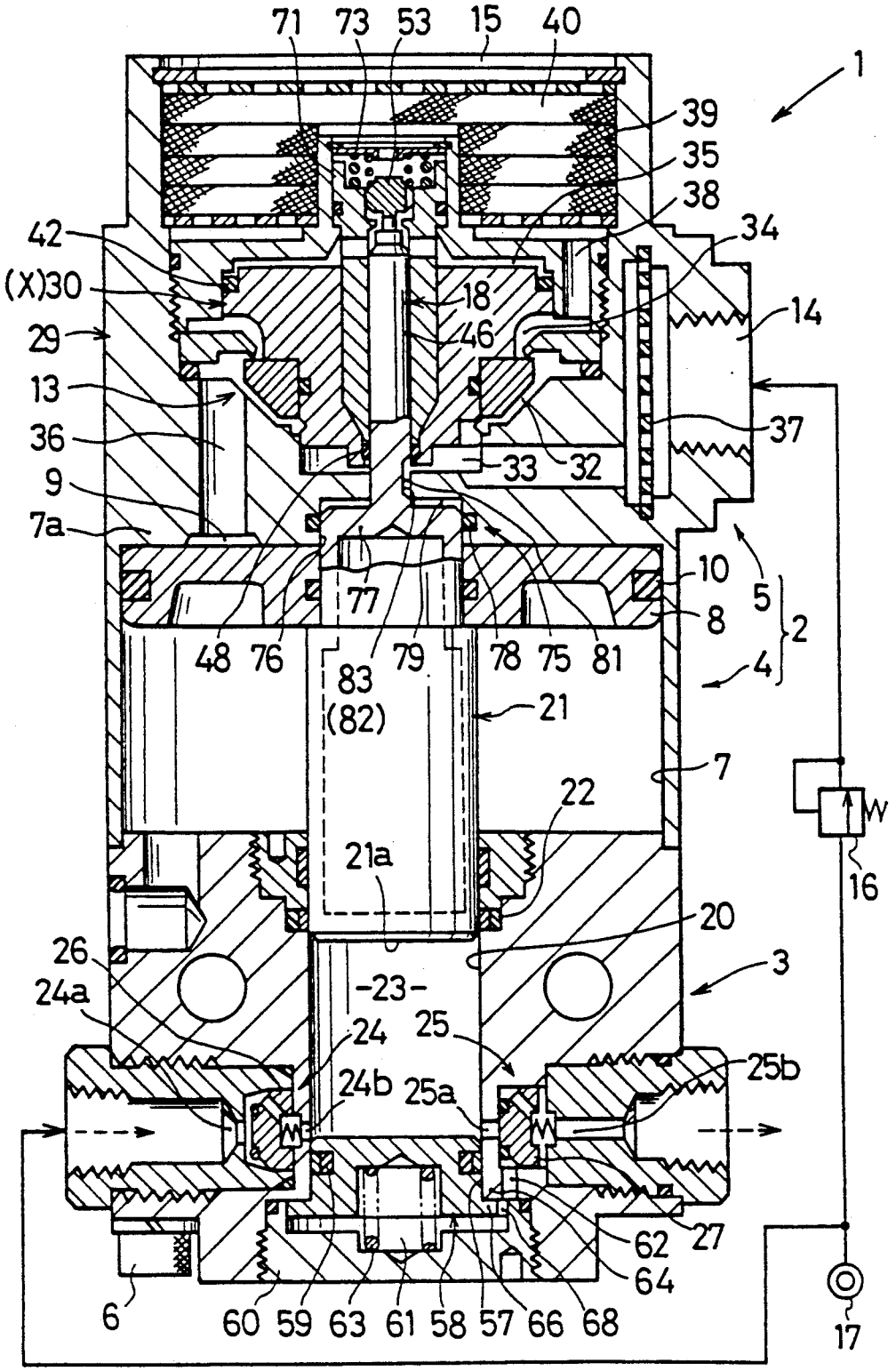
FIGS. 1 to 3 show a first embodiment of the present invention.
Figure 2:
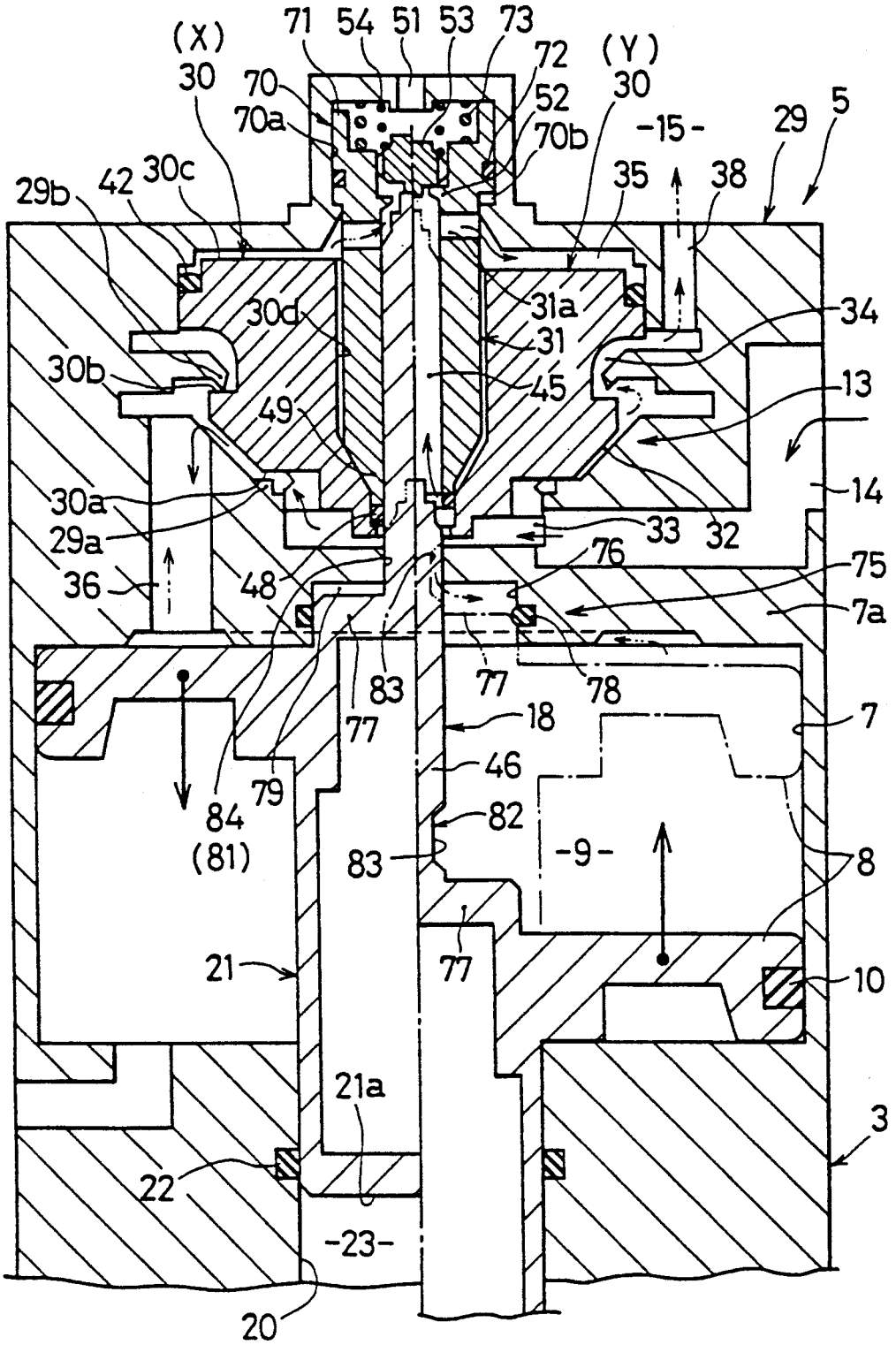
Figure 3A:
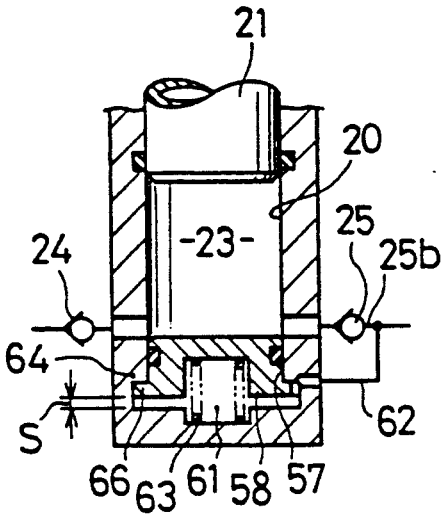
Figure 3B:
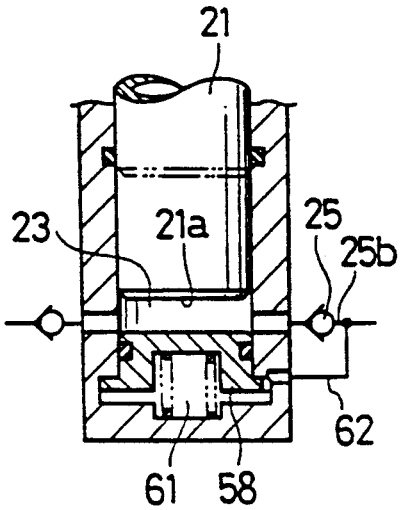
Figure 3C:
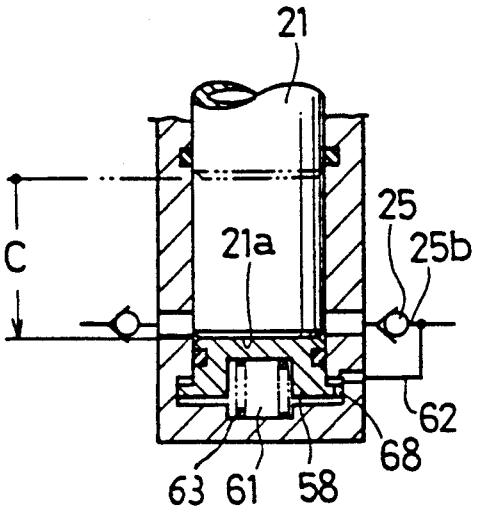
Figure 3D:
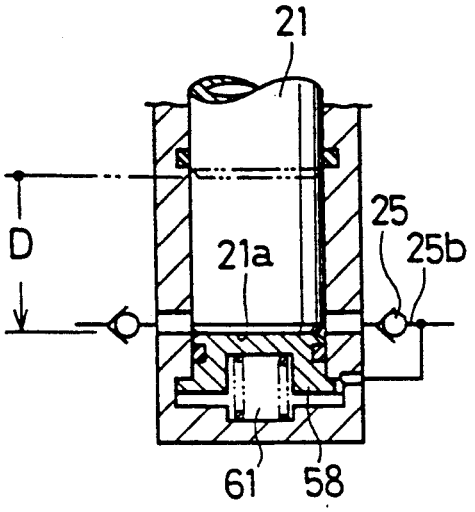

FIGS. 1 to 3 show a first embodiment of the present invention.

Referring to FIG. 1, a gas booster, designated by numeral 1, comprises a pneumatic piston engine 2 to generate reciprocating linear movement by making use of compressed air, and a plunger type gas pump 3 to be driven by the engine 2 to boost the gas.

The engine 2 has an engine body 4 for converting the pressure energy of compressed air into power, to or from which engine body 4 compressed air is supplied or discharged by a supply/discharge switching means 5. These engine body 4 and supply/discharge switching means 5 are fastened to the gas pump 3 with a plurality of tie rods 6.

The engine body 4 is constructed as follows.

A first piston 8 is inserted into a first cylinder bore 7 via a packing 10 so as to be hermetically and vertically slidable. Between a top wall 7*a*, i.e. a first end wall of the first cylinder bore 7, and the first piston there is provided an engine chamber 9. When compressed air is supplied to the engine chamber 9, the first piston is driven toward the bottom dead point. In contrast to this, when compressed air is discharged from the engine chamber 9, the first piston 8 is allowed to return toward the top dead point.

The supply/discharge switching means 5, having a supply/discharge valve 13, serves to make the engine chamber 9 selectively connect to a supply port 14 or a discharge port 15 via the supply/discharge valve 13. The supply port 14 is connected to an air compressor 17 via a pressure reducing valve 16. The discharge pressure of the compressor 17 can be set in the range from 5.0 to 9.9 kgf/cm$^2$. The discharge port 15 is open to the outside. The supply/discharge valve 13 is so arranged as to be switchable between supply position X and discharge position Y (see FIG. 2) for compressed air via a pilot valve 18.

The plunger type gas pump 3 is constructed as follows.

A plunger bore 20, smaller in diameter than the first cylinder bore 7, is formed below the first cylinder bore 7 in series. A plunger 21 is inserted into the plunger bore 20 via a packing 22 so as to be hermetically and vertically movable, the top thereof being coupled to the first piston 8. Below the bottom end 21*a* of the plunger 21 there is provided a plunger chamber 23. To a lower portion of the chamber 23, the outlet 24*b* of a first check valve 24 for gas intake and the inlet 25*a* of a second check valve 25 for gas discharge are connected. Further, the compressor 17 is connected to the inlet 24*a* of the first check valve 24.

When the first piston 8 is driven to descend, the plunger bottom end 21*a* goes into the plunger chamber 23 to increase the internal pressure, thereby pushing a valve member 26 of the first check valve 24 to be closed and simultaneously pushing a valve member 27 of the second check valve 25 to be opened, so that the compressed air increased in pressure is discharged from the outlet 25*b*. Conversely, in the ascending return stroke, the valve member 26 is pushed open by the pressure of the inlet 24*a* of the first check valve 24, so that a compressed air of approx. 5 kgf/cm$^2$ is introduced into the plunger chamber 23, its pressure causing the plunger 21 to return the first piston 8 to ascend. The above-described strokes will be repeated until the discharged compressed air finally reaches at least 40 kgf/cm$^2$ pressure.

A concrete arrangement of the supply/discharge switching means 5 is now described with reference to FIG. 1 and FIG. 2. The left half of FIG. 2 and the whole FIG. 1 each show an initial state of the descending drive stroke of the first piston 8 while the right half of FIG. 2 shows an initial state of the ascending return stroke of the same first piston 8.

The supply/discharge valve 13 is so constructed that a cylindrical supply/discharge valve member 30 is inserted into a supply/discharge valve casing 29 fixed to the upper portion of the top wall 7*a* of the first cylinder bore 7. The supply/discharge valve member 30, when pushed up, switches to the supply position X in the left half of FIG. 2 and, when pushed down, to the discharge position Y in the right half of FIG. 2.

The supply port 14 is communicated with the discharge port 15 via a filter 37, a supply actuation chamber 33, inside of a supply-side valve seat 29*a*, a working chamber 32, inside of a discharge-side valve seat 29*b*, a discharge chamber 34, a discharge hole 38, and an outlet chamber 39, in this order. The outlet chamber 39 is internally provided with a muffler 40. Further, the supply actuation chamber 33 is communicated with a discharge actuation chamber 35 via a cylinder bore 30*d* of the valve member 30. The discharge actuation chamber 35 is partitioned from the discharge chamber 34 by an O-ring 42.

As shown in the left half of FIG. 2, when the supply/-discharge valve member 30 is pushed up switchedly to the supply position X, a supply actuation pressure-receiving surface 30*a* provided at a lower portion of the valve member 30 leaves apart from the supply-side valve seat 29*a*, so that the supply actuation chamber 33 and the working chamber 32 are communicated with each other, while a discharge-side pressure-receiving surface 30*b* provided at a mid-height portion of the supply/discharge valve member 30 is seated on the discharge-side valve seat 29*b* to seal the space between the working chamber 32 and the discharge chamber 34.

Conversely to this, as shown in the right half of FIG. 2, when the supply/discharge valve member 30 is pushed down switchedly to the discharge position Y, the supply actuation pressure-receiving surface 30*a* is seated on the supply-side valve seat 29*a* so that the space between the supply actuation chamber 33 and the working chamber 32 is sealed while the discharge-side pressure-receiving surface 30*b* leaves apart from the discharge-side valve seat 29*b* so that the working chamber 32 and the discharge chamber 34 are communicated with each other.

The pilot valve 18, which is to switch the supply/discharge valve member 30 between supply position X and discharge position Y, comprises a piston type pilot valve casing 71, a spool 46 fixed to the first piston 8, an O-ring type pressure-introduction valve seat 48, a pressure-relief valve member 53, and a pressure-relief valve seat 52.

More specifically, within the upper portion of the supply/discharge valve casing 29 there is provided a cylinder chamber 70*a* for a pilot cylinder 70, into which cylinder chamber 70*a* the pilot valve casing 71 is inserted via an O-ring 72 so as to be hermetically and vertically movable. Further, a pressure-receiving actuation chamber 70*b* formed in confronting relation with the bottom face of the pilot valve casing 71 is communicated with the discharge actuation chamber 35. The pilot valve casing 71 is adapted to be driven upward against the urging force of a return spring 73 by virtue of the internal pressure of the pressure-receiving actuation chamber 70*b*. A support cylinder 31 downwardly protruding from the pilot valve casing 71 is inserted into the cylinder bore 30*d* of the supply/discharge valve member 30, and the valve seat 48 is mounted from downside to a lower portion 49 of the support cylinder 31. To the pressure-relief valve seat 52 provided within the upper portion of the pilot valve casing 71, the pressure-relief valve member 53 is downwardly urged by a valve-closing spring 54 so as to be closed. A pressure-relief port 51 disposed above the pressure-relief valve member 53 is communicated with the discharge port 15.

When the spool 46, which is to descend along with the movement of the first piston 8, is switched from a state in which it is at the top dead point as depicted by solid line in the left half of FIG. 2 to a state in which it is at the bottom dead point as depicted by two-dot chain line in the same left half figure, first the pressure-relief valve member 53 is seated on the pressure-relief valve seat 52, rendering the pressure-relief port 51 closed, and subsequently the outer circumferential surface of the spool 46 and the inner circumferential surface of the valve seat 48 will leave apart from each other. Then the compressed air within the supply actuation chamber 33 passes through the valve-opening clearance between the spool 46 and the valve seat 48, a pilot valve chamber 45, and a through hole 31*a* of the support cylinder 31, in this order, so that it is introduced into the discharge actuation chamber 35 and the pressure-receiving actuation chamber 70*b*.

By virtue of the internal pressure of the pressure-receiving actuation chamber 70*b*, the pilot valve casing 71 is elevated against urging force of the two springs 73 and 54, as depicted by solid line in the right half of FIG. 2, causing the valve seat 48 to rapidly leave apart from the spool 46. This in turn causes compressed air to be rapidly introduced into the discharge actuation chamber 35, the compressed air serving to strongly push down the supply/discharge valve member 30 switchedly to the discharge position Y in the right half figure. As a result, the engine chamber 9 is communicated with the discharge port 15 via a supply/discharge hole 36, the working chamber 32, the discharge chamber 34, and the discharge hole 38, thus allowing the first piston 8 to follow the ascending return stroke.

Incidentally, when the supply/discharge valve member 30 is pushed down, upward back pressure resistance that the supply/discharge valve member 30 receives will decrease from one force applied to the pressure-receiving sectional area of the discharge-side pressure-receiving surface 30*b* to another applied to the pressure-receiving sectional area of the supply actuation pressure-receiving surface 30*a*, on the descending way of the supply/discharge valve member 30. This arrangement ensures that the supply/discharge valve member 30 can be reliably switched to the discharge position Y with its descending speed increased from a midpoint of the descent.

Conversely to the above case, when the spool 46 is switched, along with the ascent of the first piston 8, from the bottom dead point as depicted by solid line in the right half figure to the top dead point as depicted by solid line in the left half figure, first the outer circumferential surface of the spool 46 is brought into sealing contact with the inner circumferential surface of the valve seat 48, and subsequently the pressure-relief valve member 53 is made to leave apart from the pressure-relief valve seat 52 against the valve-closing spring 54 while the discharge actuation chamber 35 is made to be communicated with the discharge port 15 via the through hole 31*a* of the support cylinder 31, the valve-opening clearance between the valve seat 52 and the valve member 53, and the pressure-relief port 51. This in turn causes the supply/discharge valve member 30 to be pushed up by the vertical differential pressure whereby it is switched to the supply position X in the left half figure. Thus the engine chamber 9 is communicated with the supply port 14 via the supply/discharge hole 36, the working chamber 32, and the supply actuation chamber 33, allowing the first piston 8 to start its descending drive stroke.

The gas pump 3 is constructed as follows.

As illustrated in FIG. 1, below the plunger bore 20 there is provided the second cylinder bore 57 having the same diameter as the bore 20. The second piston 58 confronting the bottom end 21*a* of the plunger 21 is inserted into the second cylinder bore 57 via the O-ring 59 so as to be hermetically and vertically movable. Between the second piston 58 and a plug 60 there is provided the cushion chamber 61. The plug 60 forms a second end wall of the second cylinder bore 57. The cushion chamber 61 and the outlet 25*b* of the second check valve 25 are communicated with each other via a communicating passage 62.

The second piston 58 is urged upward by a return spring 63 installed in the cushion chamber 61. A flange 66 provided at a lower portion of the second piston 58 is brought from downside into contact with a stopper 64 on the circumferential wall of the second cylinder bore 57 to thereby prevent the second piston 58 from moving upward in excess of a set extent. A notched groove of the flange 66 forms a throttle 68 of the communicating passage 62.

The second piston 58 and the cushion chamber 61, as shown in FIG. 3, operate as follows. FIGS. 3(*a*), (*b*), and (*c*) show their operation at the time of low load; FIG. 3 (*a*) depicts a state where the plunger 21 is at the top dead point, FIG. 3(*b*) depicts a state where the plunger 21 is in the course of descent, FIG. 3(*c*) depicts a state where the plunger 21 has descended to the bottom dead point. Further, FIG. 3(*d*) shows a state where the plunger 21 has descended to the bottom dead point at the time of high load.

In the state of FIG. 3(*a*), by virtue of the compressed air introduced from the first check valve 24 into the plunger chamber 23, the plunger 21 has returned to the top dead point. The second piston 58 is urged upward by the resultant force of the two: a differential pressure between an upward force due to the compressed air introduced into the cushion chamber 61 and a downward force due to the internal pressure of the plunger chamber 23, and an urging force of the return spring 63. Symbol S represents the stroke tolerance of the second piston 58.

As shown in FIG. 3(*b*), when the plunger 21 descends to thereby increase the pressure of the plunger chamber 23, the second check valve 25 is opened so that the compressed air increased in pressure is discharged through its outlet 25*b*. Then the pressure acts on the cushion chamber 61 through the communicating passage 62, holding the second piston 58 at its ascent position.

At this low-load time, since the pressure of the outlet 25*b* of the second check valve 25 and that of the plunger chamber 23 are so low that the plunger 21 will be driven to rapidly descend by the first piston 8 (see FIG. 1 or FIG. 2). Along with this movement, the bottom end 21*a* of the plunger 21 is brought into contact with the second piston 58, and subsequently the plunger 21 pushes down the second piston 58 against the pressure of the cushion chamber 61 and the return spring 63, as shown in FIG. 3 (*c*). Then the compressed air within the cushion chamber 61 is further compressed to through the communicating passage 62, pushed out to the outlet 25*b* of the second check valve 25. Symbol C in the figure represents the down stroke of the plunger 21 in this low-pressure discharge state.

With the above-described compression operation of the cushion chamber 61, the descending movement of the plunger 21 is cushioned such that its speed can be gradually reduced, which contributes to suppressing the impact force due to collision between the plunger 21 and the second piston 58. Also, in this cushioning operation, the flowout speed of compressed air, which is pushed out of the communicating passage 62 can be reduced by the flow resistance that the throttle 68 provided in the communicating passage 62 gives, so that the pressure rise ratio of the cushion chamber 61 increases to allow the descending movement of the plunger 21 to be sufficiently cushioned. Thus the vibrations and noise of the gas booster can be reduced.

In contrast to this, in the ascending return stroke, the plunger 21 goes up by virtue of the pressure of the gas introduced into the plunger chamber 23 from the first check valve 24. Then the second piston 58 returns from the descent position of FIG. 3 (*c*) to the ascent position as shown in FIG. 3(*a*).

The plunger 21 repeats the above-described ascending and descending strokes so that the pressure of the outlet 25*b* of the second check valve 25 gradually increases. With increasing pressure of the outlet 25*b*, the descending speed of the first piston 8 slows down, causing the inertia force of the first piston 8 and the plunger 21 at the time of descent to be reduced, with the result of gradually decreasing overrun of the plunger bottom end 21*a*. On this account, in the case of high load as in FIG. 3(*d*), the descending stroke D of the plunger 21 diminishes as compared with the case of low load.

Correspondingly to this operation, the pressure of the cushion chamber 61 also increases with the increasing pressure of the outlet 25*b* of the second check valve 25, while the height position of the second piston 58 at the final period of the discharge stroke gradually goes up, so that the clearance between the bottom end 21*a* of the plunger 21 and the second piston 58 is eliminated or reduced. Therefore, the compressibility of the plunger chamber 23 can be maintained at a great value, with the result of a large amount of gas discharge even at the time of high load.

With the arrangement that the return spring 63 is provided which urges the second piston 58 upward, the second piston 58 can positively be urged against the plunger bottom end 21*a* by the return spring 63 even when the gas pressure of the cushion chamber 61 is low at the time of low load, thus allowing the compressibility to be increased. This enables the gas booster 1 to be increased in compressibility over the entire region of operation and in average discharge amount.

Further, there is provided a brake means 75 for decelerating the ascending speed in the first piston 8 when the first piston 8 has ascended nearly to the top dead point.

More specifically, a third cylinder bore 76 is provided on the top wall 7*a* of the first cylinder bore 7 above the engine chamber g. The third cylinder bore 76 is so formed as to be smaller in diameter than the plunger bore 20. Also, a third piston 77 is hermetically fitted into the third cylinder bore 76 via a packing 78 so as to be vertically disengageable. The third piston 77, disposed between the plunger 21 and the spool 46, is fitted so as to be movable along with the first piston 8.

As shown in FIG. 2, at a final period of the upward return movement of the first piston 8, a brake chamber 79 is formed above the third piston 77 within the third cylinder bore 76. The brake chamber 79 and the supply port 14 are connected with each other via a communicating passage 81. An opening/closing means 82 for opening and closing the communicating passage 81 is composed of a groove 83 formed at the lower part of the spool 46 and a through hole 84 of the top wall 7*a* of the first cylinder bore 7.

The brake chamber 79 and the opening/closing means 82 operate in the following manner.

Referring to the right half of FIG. 2, as the first piston 8 ascends from the bottom dead point as depicted by solid line in the figure to the position as depicted by dash-and-dot line, the third piston 77 also ascends from the position as depicted by solid line in the figure to the position as depicted by dash-and-dot line.

At an early to intermediate period of the ascending movement of the first piston 8, the compressed air within the engine chamber 9 is discharged via the supply/discharge hole 36, the working chamber 32, the discharge chamber 34, and the discharge hole 38, as shown by two-dot chain lined arrow. The brake chamber 79 is communicated with the engine chamber 9 while the upper external circumferential surface of the spool 46 serves to close the through hole 84.

When the first piston 8 goes up nearly to the top dead point, the third piston 77 is brought into sealing contact with the packing 78, thereby partitioning the brake chamber 79 from the engine chamber 9, while the groove 83 of the spool 46 comes to confront the through hole 84, thereby making the supply actuation chamber 33 communicate with the brake chamber 79. Then the compressed air within the supply actuation chamber 33 is introduced from the groove 83 into the brake chamber 79, the pressure of the compressed air serving to urge the third piston 77 downward. As a result, the ascending speed of the first piston 8 is decelerated such that the compressed air of the outlet 24*b* of the first check valve 24 is gradually introduced into the plunger chamber 23, to thereby increase the intake pressure of the plunger chamber 23. Thus the push-up force acting from the plunger chamber 23 to the plunger 21 overcomes the push-down force derived from the brake chamber 79, causing the first piston 8 to move to the top dead point.

In this way, as the intake pressure of the plunger chamber 23 increases, the next discharge amount also increases. The increase in the discharge amount will appear to be a remarkable advantage at the time of low load when the pressure of the outlet 25*b* of the second check valve 25 is low. That is, as previously described, the gas booster 1 operates depending on the balance between the descending drive force, which acts from the engine chamber 9 onto the first piston 8, and the discharge reaction force, which acts from the plunger chamber 23 onto the plunger 21, so that the pressure of the engine chamber 9 will increase as the pressure of the outlet 25*b* increases. In other words, the pressure of the engine chamber 9 is lower at the time of low load than at the time of high load. For this reason, with the low load, the back pressure resistance within the engine chamber 9 is small and the ascending return time of the first piston 8, short. As a result of this, the intake pressure of the plunger chamber 23 decreases, the next discharge amount also diminishing. With the brake means 75 of the present invention, however, the next discharge amount can be increased by heightening the intake pressure of the plunger chamber 23 at the time of low load, so that the average discharge amount is increased to thereby allow the boosting time for reaching a set pressure (approx. 40 kgf/cm$^2$ in this embodiment) to be reduced. Needless to say, also with high load, the next discharge amount increases as the intake pressure of the plunger chamber 23 increases.

The foregoing first embodiment can be modified as follows.

The gas booster 1, instead of being arranged in its longitudinal position, may also be positioned in a lateral or slanting position or in a vertically inverted position.

The supply/discharge switching means 5 may also be of the type described in the above-mentioned U.S. Pat. Nos. 4,042,311 or 4,812,109 or the like.

The plunger bore 20 and the second cylinder bore 57 are preferably made into the same diameter from a viewpoint of their manufacture, but may be of different diameters.

Below the first piston 8 there may be added a return spring for ascending and returning the first piston 8.

It is possible to omit the return spring 63 that has been provided in the cushion chamber 61. However, since the return spring 63, provided as in the above embodiment, allows the second piston 58 to be urged into contact with the plunger 21 by the return spring 63 in the low-load operation, the compressibility at the time of low load becomes also great to elevate the average compressibility.

Working fluid of the gas pump 3 may be nitrogen gas or helium gas in place of compressed air. Further, the gas increased in pressure by the gas pump 3 may be of the kind other than the one supplied to the engine 2.

The respective packings 10, 59, and 78 of the cylinder bores 7, 57, and 76 may be X-rings or U-packings in place of O-rings.

FIG. 4, FIGS. 5 and 6, and FIG. 7 illustrate second to fourth embodiments, respectively, where like components and members having the same construction as in the first embodiment are designated by like numerals in principle.

Second Embodiment

In this embodiment, the brake means 75 is modified as follows.

Figure 4:
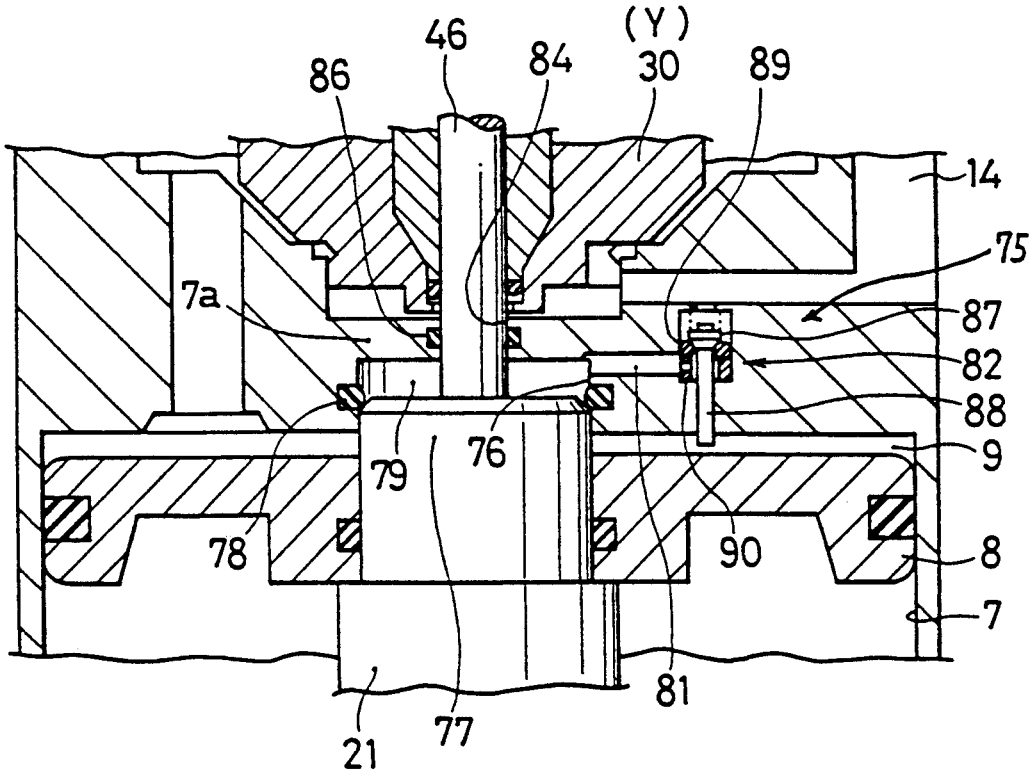
FIG. 4, showing a second embodiment of the present invention, is a segmentary view illustrating a brake means of a first piston.

As shown in FIG. 4, the space between the through hole 84 of the cylinder top wall 7*a* and the spool 46 is sealed by a packing 86. Further, the opening/closing means 82 is composed of a check valve member 87 and a valve-opening rod 88 protruding downwardly from the valve member 87. A check valve seat 89 formed from an O-ring is received by a support cylinder 90 from below.

When the first piston 8 has ascended nearly to the top dead point, the first piston 8 pushes up the rod 88, causing the check valve member 87 to leave apart from the O-ring 89. As a result, the compressed air within the supply port 14 is introduced into the brake chamber 79 via the communicating passage 81.

Third Embodiment

Figure 5:
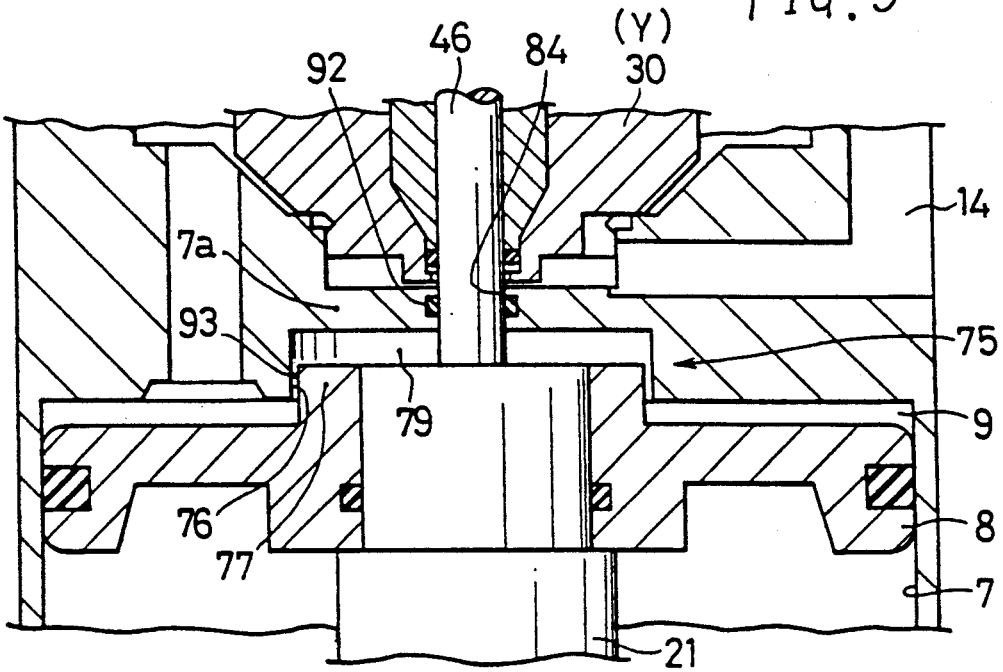
FIGS. 5 and 6 show a third embodiment of the present invention.
Figure 6:
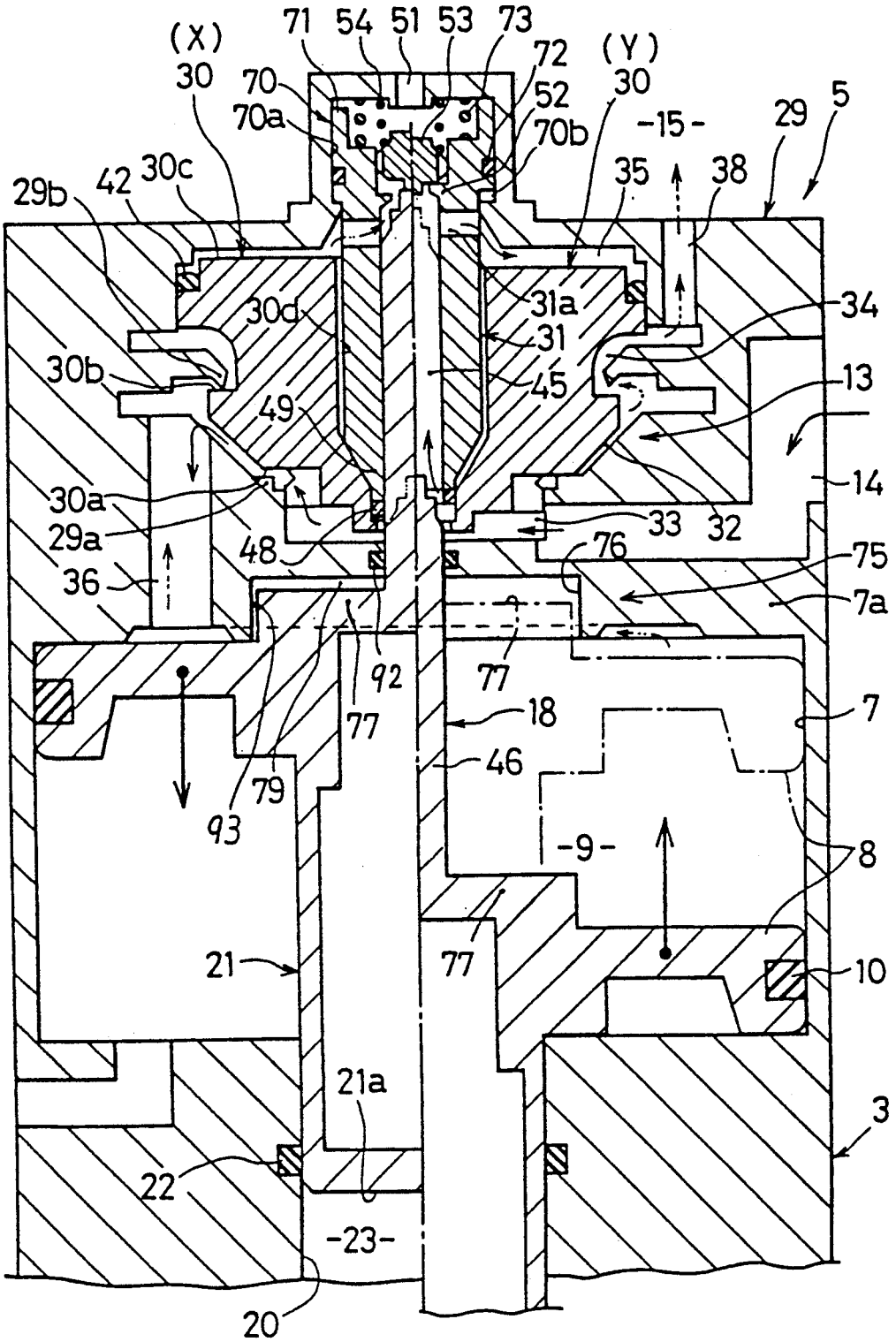

In this embodiment, the brake means 75 is modified as shown in FIGS. 5 and 6.

As in FIG. 4, the space between the spool 46 and the through hole 84 of the cylinder top wall 7*a* is sealed by a packing 92. The brake chamber 79 is communicated with the engine chamber 9 via a throttling clearance 93 formed from a fitting clearance between the third cylinder bore 76 and the third piston 77.

The brake chamber 79 and the throttling clearance 93 operate as follows.

In the right half of FIG. 6, as the first piston 8 ascends from the bottom dead point as depicted by solid line in the figure to the point as depicted by dash-and-dot line, the third piston 77 also ascends from the position as depicted by solid line in the figure to the position as depicted by dash-and-dot line.

At an early to intermediate period of the ascending movement of the first piston 8, the compressed air within the engine chamber 9 is discharged to outside via the supply/discharge hole 36, the working chamber 32, the discharge chamber 34, and discharge hole 38 in this order, as indicated by two-dot chain lined arrow. The brake chamber 79 is open to the engine chamber 9.

When the first piston 8 has ascended nearly to the top dead point, the third piston 77 is fitted into the third cylinder bore 76 so that the internal pressure of the brake chamber 79 is increased by virtue of the throttling effect of the throttling clearance 93. The internal pressure being applied to the top surface of the third piston 77 as a back pressure, the ascending speed of the first piston 8 is reduced so that the compressed air at the outlet of the first check valve (not shown) is gradually introduced into the plunger chamber 23, to thereby increase the intake pressure of the plunger chamber 23. Then the push-up force acting from the plunger chamber 23 onto the plunger 21 overcomes the push-down force applied from the brake chamber 79, thus causing the first piston 8 to move up to the top dead point.

Accordingly, even with low load, the plunger chamber 23 takes in a sufficient amount of gas to increase the pressure of the plunger chamber 23, so that the next discharge amount is increased. As a result, the gas booster has a greater average discharge amount, capable of reducing the boosting time to reach a set pressure (approx. 40 $kgf/cm^2$ in this embodiment).

Moreover, achieving the above-described advantage only requires the third piston 77 to be fitted into the third cylinder bore 76, permitting a simplified construction.

Fourth Embodiment

In this embodiment, the brake means 75 in FIG. 5 and FIG. 6 is further modified as follows.

Figure 7:
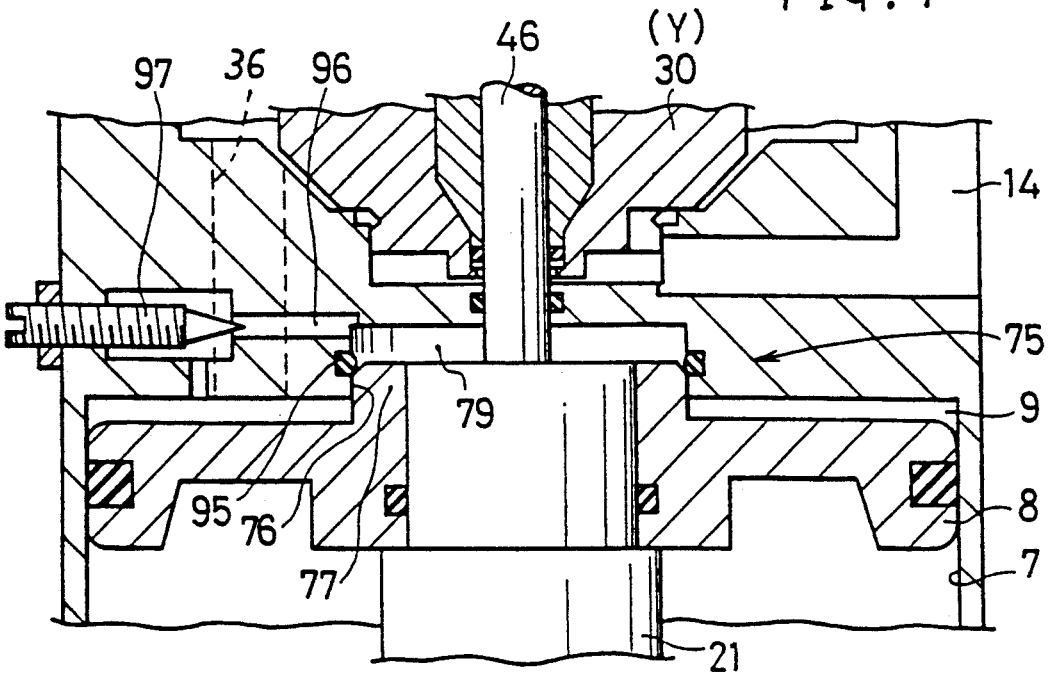
FIG. 7, showing a fourth embodiment of the present invention, is a view equivalent to FIG. 4.

As shown in FIG. 7, the space between the third cylinder bore 76 and the third piston 77 is sealed from each other by a packing 95 while the brake chamber 79 and the engine chamber 9 are communicated with each other via an exhaust passage 96, in which exhaust passage 96 there is provided a throttle valve 97 formed from a needle valve.

With this arrangement, when the first piston 8 ascends nearly to the top dead point with the third piston 77 hermetically fitted into the third cylinder bore 76, the internal pressure of the brake chamber 79 is increased by virtue of the throttling effect of the throttle valve 97, decreasing the ascending speeds of the first piston 8 and the plunger 21. As a result, the intake pressure of the plunger chamber increases to thereby increase the next discharge amount correspondingly, allowing the boosting time to be reduced. Moreover, since the exhaust speed from the brake chamber 79 can be controlled by the throttle valve 97, the brake force applied to the first piston 8 can be finely adjusted advantageously.

It is noted that the exhaust passage 96 may alternatively be communicated with the supply/discharge hole 36 or the like instead of being communicated with the engine chamber 9.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A gas booster having a fluid-pressure piston engine (2) provided on a first end side and a plunger type gas pump (3) provided on a second end side, comprising:

a first cylinder bore (7) having a first end wall (7*a*), plunger bore (20) smaller in diameter than the first cylinder bore (7), and a second cylinder bore (57) having a second end wall (60), the bores being formed in this order from the first end side toward the second end side with the diameter of the plunger bore (20) being substantially equal to the diameter of the second cylinder bore (57);

a first piston (8) inserted into the first cylinder bore (7), the first piston (8) having a first end portion and a second end portion;

a plunger (21) inserted into the plunger bore (20) and coupled with the second end portion of the first piston (8), the plunger (21) being adapted to extend into the second cylinder bore (57);

a second piston (58) inserted into the second cylinder bore (57);

an engine chamber (9), formed between the first end wall (7*a*) and the first piston (8) to and from which a pressurized fluid is supplied and discharged by a supply/discharge switching means (5);

a plunger chamber (23) defined by said plunger bore (20) and formed between the plunger (21) and the second piston (58);

a cushion chamber (61) formed between the second end wall (60) and the second piston (58);

a first check valve (24) for gas intake and a second check valve (25) for gas discharge having an outlet (25*b*), the check valves being connected internally to the plunger chamber (23) adjacent the second cylinder bore (57), a communicating passage (62) for connecting the cushion chamber (62) to the outlet (25*b*) of the second check valve (25); and a stopper (64) for preventing the second piston (58) from moving toward the first end side in excess of a set extent.

2. A gas booster as claimed in claim 1, wherein a return spring (63) is further provided in the cushion chamber 61 for urging the second piston (58) toward the first end side.

3. A gas booster as claimed in claim 2, wherein a throttle (69) is further provided in the communicating passage (62).

4. A gas booster as claimed in claim 1, further comprising:

a brake-use third cylinder bore (76) formed outside of the first end wall of the first cylinder bore (7);

a brake-use third piston (77) inserted into the third cylinder bore (76) and coupled with the first end portion of the first piston (8);

a brake chamber (79) formed between the first end wall (7*a*) and the third piston (77); and means for increasing internal pressure of the brake chamber (79) at a final period of movement of the first piston (8) toward the first end side.

5. A gas booster as claimed in claim 4, wherein the third piston (77) is hermetically fitted into the third cylinder bore (76) at a final period of movement of the first piston (8) toward the first end side; a communicating passage (81) is provided for connecting the supply port (14) of the supply/discharge switching means (5) with the brake chamber (79); and wherein an opening/closing means (82) is interlocked and coupled with the first piston (8) for closing the communicating passage (81) at an early to intermediate period of movement of the first piston (8) toward the first end side and for opening the communicating passage (81) at a final period of the same movement.

6. A gas booster as claimed in claim 4, wherein the third piston (77) is fitted into the third cylinder bore (76) at a final period of movement of the first piston (8) toward the first end side by opening a throttling clearance (93), and the brake chamber (79) is communicated with the engine chamber (9) via the throttling clearance (93).

7. A gas booster as claimed in claim 4, wherein the third piston (77) is hermetically fitted into the third cylinder bore (76) at a final period of movement of the first piston (8) toward the first end side; an exhaust passage (96) is further provided in the first end wall (7a) so as to be communicated with the brake chamber (79); and wherein a throttle valve (97) is provided in the exhaust passage (96).

* * * * *